US007507098B1

(12) United States Patent
Hung

(10) Patent No.: US 7,507,098 B1
(45) Date of Patent: Mar. 24, 2009

(54) CARD CONNECTOR

(75) Inventor: Pei-Chiao Hung, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/050,798

(22) Filed: Mar. 18, 2008

(51) Int. Cl.
*H01R 13/62* (2006.01)

(52) U.S. Cl. ..... 439/159; 439/630; 439/946

(58) Field of Classification Search ..... 439/152, 439/159, 160, 630, 923, 945, 946
See application file for complete search history.

(56) References Cited

U.S. PATENT DOCUMENTS 6,478,592 B1 * 11/2002 Hu et al. ..... 439/159
6,935,898 B2 * 8/2005 Lai ..... 439/630
7,425,157 B1 * 9/2008 Hung ..... 439/630

* cited by examiner

*Primary Examiner*—James Harvey
(74) *Attorney, Agent, or Firm*—WPAT, P.C.; Anthony King

(57) ABSTRACT

A card connector includes an insulating housing, a plurality of terminals received in the insulating housing, a preventing member and an ejecting device. The insulating housing has a base portion. Two sidewalls extend upward from both sides of the base portion and a rear wall extends upward from the rear of the base portion. The sidewalls and the rear wall define a chamber therebetween for receiving a card. The preventing member is configured at one side of the insulating housing and has a base bar extending longitudinally. Two ends of the base bar protrude into the chamber to form a pair of propping sections for elastically propping one side of the card. The ejecting device is configured at the other side of the insulating housing opposite to the preventing member for operably withdrawing the card from the card connector.

8 Claims, 4 Drawing Sheets

CARD CONNECTOR

BACKGROUND OF THE INVENTION

1. Field of the Invention

The present invention relates to a card connector for receiving a card, and more particularly to a card connector capable of preventing the card from being shot off in the process of withdrawing the card from the card connector.

2. The Related Art

Traditionally, a card connector has an ejecting device used for withdrawing an external card from the card connector. The ejecting device includes a sliding body, a spring and a connecting bar. While the card is inserted into the card connector, the card pushes the sliding body to move. Then the spring is compressed and the connecting bar jostles the sliding body to make the sliding body and the spring relatively immovable. While the card is withdrawn from the card connector, the connecting bar departs from the sliding body. The power stored in the spring releases and drives the spring to reposition and further drives the sliding body to reposition. The sliding body pushes the card to take out of the card connector. However, in the process of withdrawing the card from the card connector, for the above-mentioned card connector has no preventing members to slow down the speed of the card moving outward under the action of the ejecting device, the card is apt to be shot off from the card connector so that the card is lost or damaged. Therefore, a card connector capable of preventing the card from being shot off is required.

SUMMARY OF THE INVENTION

An object of the present invention is to provide a card connector, which can prevent a card from being shot off in the process of withdrawing the card from the card connector.

The card connector includes an insulating housing, a plurality of terminals received in the insulating housing, a preventing member and an ejecting device. The insulating housing has a base portion. Two sidewalls extend upward from both sides of the base portion and a rear wall extends upward from the rear of the base portion. The sidewalls and the rear wall define a chamber therebetween for receiving a card. The preventing member is configured at one side of the insulating housing and has a base bar extending longitudinally. Two ends of the base bar protrude into the chamber to form a pair of propping sections for elastically propping one side of the card. The ejecting device is configured at the other side of the insulating housing opposite to the preventing member for operably withdrawing the card from the card connector.

As described above, the propping sections elastically prop the card so as to generate a friction to the card. The friction generated thereby can slow down the speed of the card moving outward so as to prevent the card from being shot off from the chamber by the ejecting device in the process of withdrawing the card.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
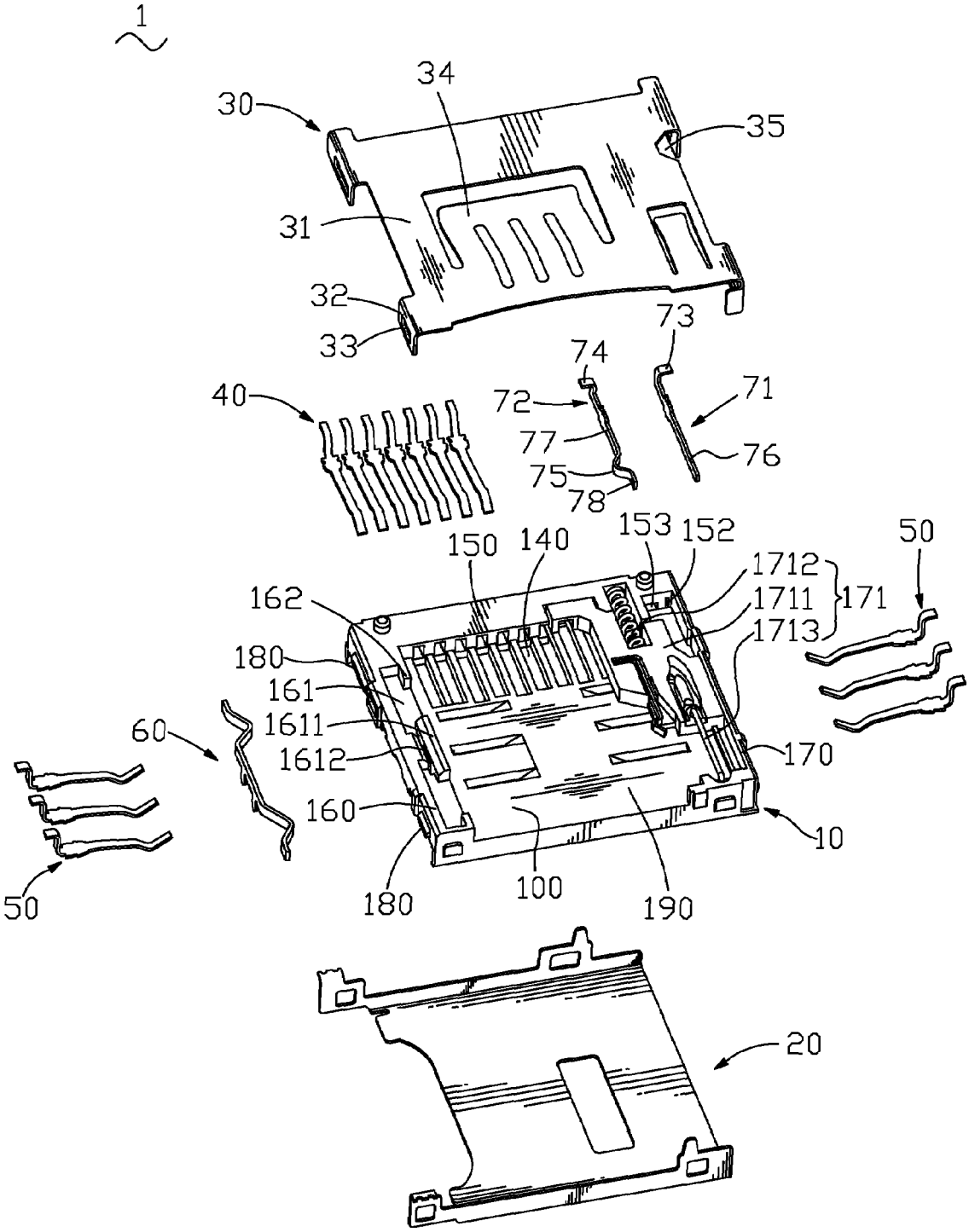
FIG. 1 is an exploded view of a card connector in accordance with an exemplary embodiment of the present invention.
Figure 2:
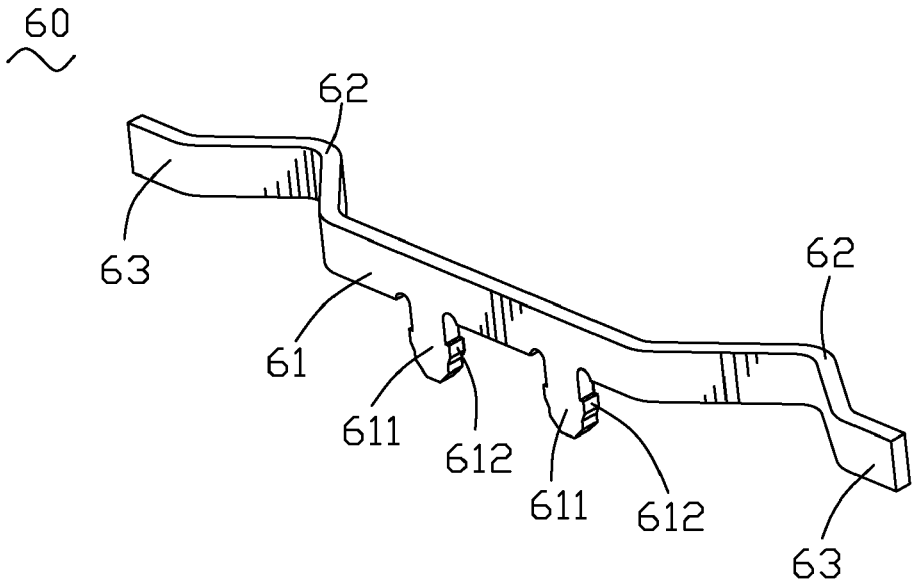
FIG. 2 is a perspective view of a preventing member of the card connector of FIG. 1.
Figure 3:
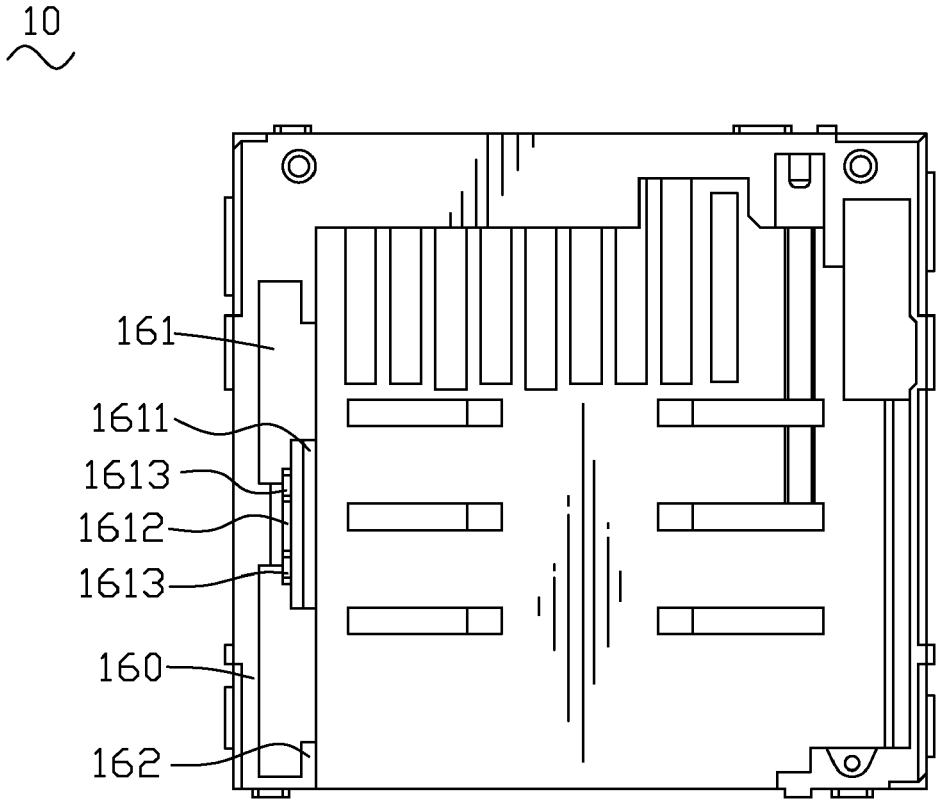
FIG. 3 is a vertical view of an insulating housing of the card connector of FIG. 1.

Referring to FIG. 1, a card connector 1 that is adapted for receiving two types of cards and allows the cards to be inserted thereinto from two different directions is shown. The card connector 1 includes an insulating housing 10, a bottom cover 20, a top cover 30, a plurality of first terminals 40, a plurality of second terminals 50 and a preventing member 60 held in the insulating housing 10.

Figure 5:
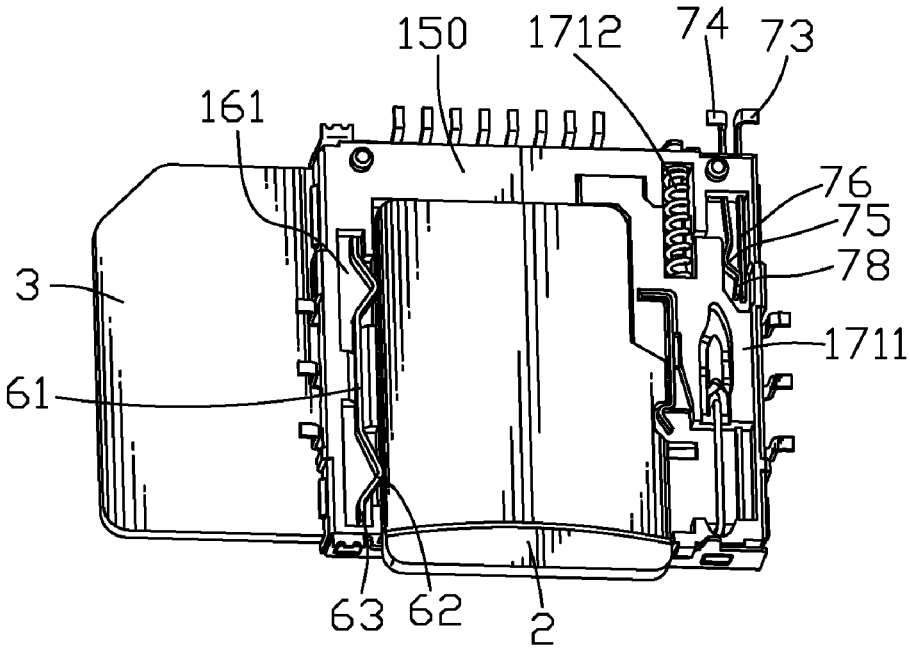
FIG. 5 is a perspective view of the card connector without covers, in which a first card and a second card are inserted.

Referring to FIG. 1 again, the insulating housing 10 has a rectangular base portion 100. Two opposite sides of the base portion 100 respectively extend upward to form a left sidewall 160 and a right sidewall 170. A rear wall 150 extends upward from the rear of the base portion 100. The left sidewall 160, the right sidewall 170 and the rear wall 150 define a first chamber 190 therebetween for receiving a first card 2 as best shown in FIG. 5. The rear of the base portion 100 longitudinally defines a plurality of first terminal cavities 140 penetrating through the rear wall 150 for receiving the corresponding first terminals 40. The left sidewall 160 and the right sidewall 170 define a plurality of locking blocks 180 at the outside thereof. An ejecting device 171 is configured in the right of the insulating housing 10 and adjacent to the inside of the right sidewall 170. The ejecting device 171 is used for withdrawing the first card 2 from the first chamber 190 and includes a sliding body 1711, a spring 1712 and a connecting bar 1713. The ejecting device 171 is widely used and known very well by technicians of this field, so the ejecting device 171 is gone into details no longer here.

Referring to FIG. 1 and FIG. 5, the rear wall 150 defines a first aperture 152 adjacent to the right sidewall 170 and a second aperture 153 located adjacent the left of the first aperture 152. The first aperture 152 and the second aperture 153 extend longitudinally and penetrate through the rear wall 150. A first monitoring terminal 71 is inserted in the first aperture 152 and a second monitoring terminal 72 is inserted in the second aperture 153. The first monitoring terminal 71 and the second monitoring terminal 72 respectively have a first fixing portion 76 and a second fixing portion 77 extending longitudinally. The rear of the fixing portions 76, 77 extend upward and then respectively bend rightward and leftward to form a first soldering portion 73 and a second soldering portion 74. The front of the second fixing portion 77 is arched leftward to form an elastic portion 75. A free end of the elastic portion 75 extends forward to form a contact portion 78. The fixing portions 76, 77 respectively pass through the corresponding apertures 152, 153 to be located between the right sidewall 170 and the sliding body 1711 for monitoring whether the first card 2 is inserted at a right position or not. The soldering portions 73, 74 protrude out of the rear of the rear wall 150 to be soldered to an external printed circuit board (not shown).

Referring to FIGS. 1, 2, 3 and 5, the top of the left sidewall 160 defines an accommodating cavity 161 extending longitudinally and connecting the first chamber 190. Two opposite end walls of the accommodating cavity 161 respectively have a portion protruding into the accommodating cavity 161 to form a pair of preventing walls 162 facing to each other. The middle of the bottom of the accommodating cavity 161 protrudes upward to form an obstructing portion 1611 apart from the preventing walls 162. The obstructing portion 1611 defines a fixing channel 1612 extending longitudinally and connecting the accommodating cavity 161. The bottom of the fixing channel 1612 defines two fixing holes 1613 extending downward respectively. The preventing member 60 is received in the accommodating cavity 161 and has a base bar 61 extending longitudinally. The bottom of the base bar 61 extends downward to form two inserting sections 611 and a plurality of bumps 612 are defined at two side edges of the inserting sections 611. Two ends of the base bar 61 are arched rightward to form a pair of propping sections 62. A free end of each of the propping sections 62 extends a little longitudinally to form a tail section 63. The base bar 61 is fixed in the fixing channel 1612. The inserting section 611 is inserted in the respective fixing hole 1613 and the bumps 612 abut against inner walls of the corresponding fixing hole 1613. The propping sections 62 are respectively located between the obstructing portion 1611 and the corresponding preventing walls 162 and stretches into the first chamber 190. The tail section 63 is against the respective preventing wall 162.

Figure 4:
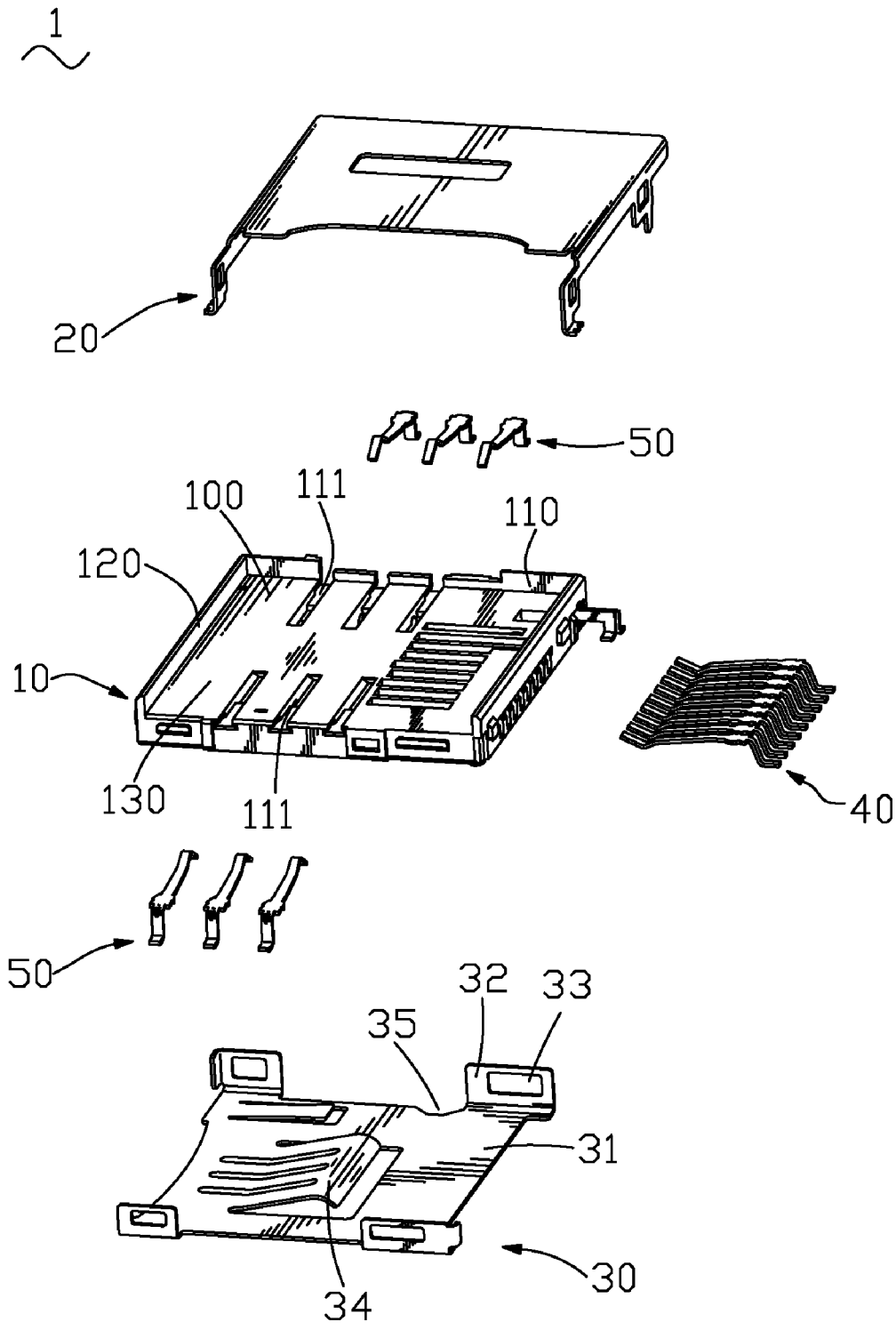
FIG. 4 is another angle exploded view of the card connector of FIG. 1.
Figure 6:
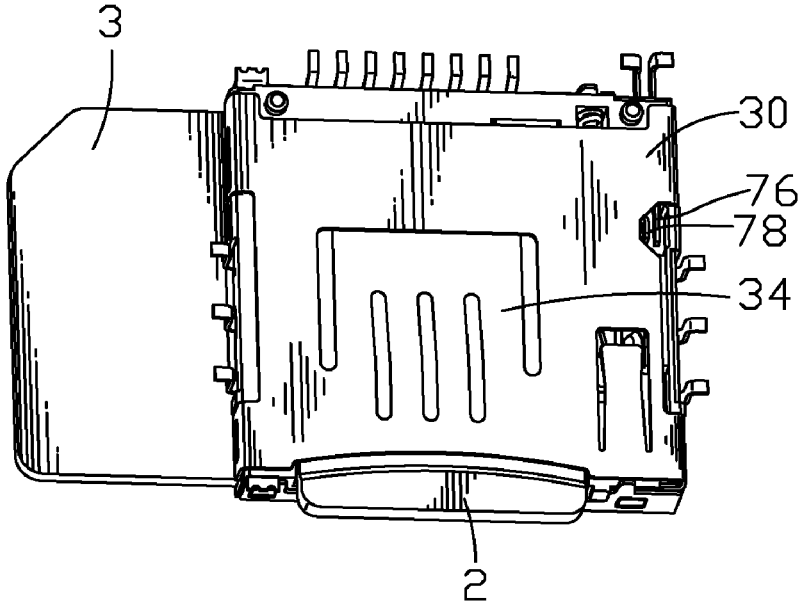
FIG. 6 is a perspective view of the card connector of FIG. 1, in which the first card and the second card are inserted.

Please referring to FIGS. 1, 4 and 6, the top cover 30 is coupled with the top of the insulating housing 10 and has a base plate 31. Two opposite sides of the base plate 31 respectively define two side plates 32 extending downward at two ends thereof. Each of the side plates 32 defines a locking opening 33 and the locking block 180 of the insulating hosing 10 buckles into the respective locking opening 33 to fix the top cover 30. The middle of the base plate 31 defines an elastic plate 34 having a front end connected to the base plate 31 and a rear end inclining downward freely and then bending upward to stretch into the first chamber 190. The right of the base plate 31 defines a mouth 35 facing to the contact portion 78 of the second monitoring terminal 72 for visually monitoring whether the monitoring terminals 71, 72 contact with each other right or not in the process of production.

Please referring to FIG. 4, one side of the bottom of the base portion 100 of the insulating housing 10 extends downward to form a side wallboard 110. The front and the rear of the bottom of the base portion 100 respectively extend downward to form a pair of preventing wallboards 120. The side wallboard 110 and the preventing wallboards 120 define a second chamber 130 therebetween for receiving a second card 3 as best shown in FIG. 5. Two sides of the bottom of the base portion 100 respectively define a plurality of second terminal cavities 111 perpendicular with the first terminal cavities 140 for receiving the corresponding second terminals 50. The bottom cover 20 is coupled with the bottom of the insulating housing 10.

Please referring to FIGS. 5 and 6, while the first card 2 is inserted into the first chamber 190 of the card connector 1, the first card 2 pushes the sliding body 1711 to move rearward and the spring 1712 is compressed. At the same time, the first card 2 pushes the propping section 62 sideward to make the propping section 62 generate a pushing force. The pushing force makes the propping section 62 elastically prop the right of the first card 2. Meanwhile, the elastic plate 34 elastically abuts against the top of the first card 2. The sliding body 1711 pushes the elastic portion 75 of the second monitoring terminal 72 to make the contact portion 78 contact the first fixing portion 76 of the first monitoring terminal 71. At this moment, the first card 2 is inserted in the first chamber 190 right. While the first card 2 is withdrawn from the first chamber 190, the release of the elastic force of the spring 1712 pushes the sliding body 1711 to move forward and further drives the first card 2 to take out of the first chamber 190. At the same time, the contact portion 78 repositions to apart from the first fixing portion 76. In the process of withdrawing the first card 2, the friction from the propping section 62 and the elastic plate 34 to the first card 2 can slow down the speed of the first card 2 moving outward so as to prevent the first card 2 from being shot off unexpectedly by the ejecting device 171.

As described above, the propping section 62 and the elastic plate 34 stretch into the first chamber 190 to elastically prop the first card 2 inserted in the first chamber 190 so that the friction generated thereby can slow down the speed of the first card 2 moving outward so as to prevent the first card 2 from being shot off in the process of withdrawing the first card 2 from the card connector 1. In addition, the mouth 35 of the top cover 30 is set up to face to the contact portion 78 for monitoring whether the monitoring terminals 71, 72 contact with each other right or not in the process of production so as to judge whether the first card 2 is inserted at a right position or not.

What is claimed is:

1. A card connector, comprising:

an insulating housing having a base portion, two sidewalls extending upward from both sides of the base portion and a rear wall extending upward from the rear of the base portion, the sidewalls and the rear wall defining a chamber therebetween for receiving a card;

a plurality of terminals received in the insulating housing;

a preventing member configured at one side of the insulating housing and having a base bar extending longitudinally, two ends of the base bar protruding into the chamber to form a pair of propping sections for elastically propping one side of the card; and an ejecting device configured at the other side of the insulating housing opposite to the preventing member for operably withdrawing the card from the card connector.

2. The card connector as claimed in claim 1, wherein a bottom of the base bar of the preventing member extends downward to define at least one inserting section for fixing the preventing member in the insulating housing.

3. The card connector as claimed in claim 2, wherein two side edges of the inserting section respectively define a bump.

4. The card connector as claimed in claim 1, wherein the base bar is arched to form the two propping sections, an end of each of the propping sections connects a tail section.

5. The card connector as claimed in claim 4, wherein a top of one of the sidewalls defines an accommodating cavity extending longitudinally and connecting the chamber for receiving the preventing member, two opposite end walls of the accommodating cavity respectively have a portion protruding into the accommodating cavity to form a pair of preventing walls facing to each other, the middle of a bottom of the accommodating cavity protrudes upward to form an obstructing portion apart from the preventing walls, the obstructing portion defines a fixing channel extending longitudinally and communicating the accommodating cavity, the base bar of the preventing member is fixed in the fixing channel, the propping sections are respectively located between the obstructing portion and the corresponding preventing wall, the tail section is against the respective preventing wall.

6. The card connector as claimed in claim 1, further comprising two monitoring terminals respectively having a fixing portion extending longitudinally, the fixing portions being located between the ejecting device and the corresponding sidewall, the rear of each of the fixing portions passing through the rear wall and forming a soldering portion for being soldered to a printed circuit board, the front of one of the fixing portions adjacent to the ejecting device being arched to form an elastic portion, a free end of the elastic portion extending forward to form a contact portion, the elastic portion being pushed outward by the ejecting device to make the contact portion contact the other fixing portion far from the ejecting device when the card is pushed into the chamber or springing back to make the contact portion apart from the other fixing portion when the card is withdrawn.

7. The card connector as claimed in claim 6, further comprising a cover, the cover defining a mouth facing to the contact portion.

8. The card connector as claimed in claim 1, further comprising a cover covered on the insulating housing, the cover having a base plate, a middle of the base plate defining an elastic plate with a front end thereof connected to the base plate and a rear end thereof inclining downward freely to stretch into the chamber for elastically propping the card.

* * * * *